US007326063B1

(12) United States Patent
Raudenbush et al.

(10) Patent No.: US 7,326,063 B1
(45) Date of Patent: Feb. 5, 2008

(54) PANEL MOUNT CONNECTOR HOUSING

(75) Inventors: James Michael Raudenbush, Halifax, PA (US); John Wesley Hall, Harrisburg, PA (US); Douglas John Hardy, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/671,641

(22) Filed: Feb. 6, 2007

(51) Int. Cl.
*H01R 12/00* (2006.01)

(52) U.S. Cl. ..... 439/63; 439/581

(58) Field of Classification Search ..... 439/63, 439/578, 581, 582, 607, 564, 563
See application file for complete search history.

(56) References Cited

U.S. PATENT DOCUMENTS 4,273,407 A * 6/1981 Snuffer et al. ..... 439/579
5,326,280 A * 7/1994 Briones et al. ..... 439/581
6,074,218 A * 6/2000 Wu et al. ..... 439/63
6,210,215 B1 * 4/2001 Hwang ..... 439/545
6,386,888 B1 * 5/2002 Skopic et al. ..... 439/63
6,676,445 B2 1/2004 Hall et al.
6,679,726 B1 * 1/2004 Tunn et al. ..... 439/565
6,824,403 B2 * 11/2004 Hall et al. ..... 439/108
6,875,052 B1 * 4/2005 Lo et al. ..... 439/564
2004/0242064 A1 * 12/2004 Chang et al. ..... 439/564
2007/0093126 A1 * 4/2007 Tsuo ..... 439/563

* cited by examiner

*Primary Examiner*—Hien Vu

(57) ABSTRACT

A housing is provided for use in an electrical connector. The housing includes an electrically conductive body having a first mating end and a second mating end. The first mating end is configured for coupling an electrical connector. The second mating end is configured for coupling an electrical board assembly. An electrically conductive flange extends from the body in electrical communication with the body. The flange extends through an opening formed in an electrically conductive member and is detachably securable to the electrically conductive member for maintaining electrical communication between the member and the body.

10 Claims, 6 Drawing Sheets

PANEL MOUNT CONNECTOR HOUSING

FIELD OF THE INVENTION

The present invention relates generally to housings for use in electrical connectors and, more particularly, to a panel mount electrical connector.

BACKGROUND OF THE INVENTION

Radio frequency (RF) coaxial cable connector assemblies have been used for numerous automotive applications, such as global positioning systems (GPS), car radios, mobile phones, air bag systems, and multimedia devices. Coaxial cables typically consist of an outer conductor, an inner conductor, a dielectric, and a jacket. The outer conductor and the inner conductor of the cable often electrically interface with a mating coaxial cable through jack and plug connectors. Such conventional coaxial cable connectors are known in the art, for example, in U.S. Pat. Nos. 6,676,445 and 6,824,403, which are assigned to the assignee of the present invention and are expressly incorporated by reference herein.

In order to standardize various types of connectors and thereby avoid confusion, certain industry standards have been established. One of these standards is referred to as FAKRA. FAKRA is the Automotive Standards Committee in the German Institute for Standardisation, representing international standardization interests in the automotive field. The FAKRA standard provides a system, based on keying and color coding, for proper connector attachment. The keying and color identifying features of a FAKRA connector are typically on an outer housing made of plastic or non-conductive material. Like jack keys can only be connected to like plug keyways in FAKRA connectors. Secure positioning and locking of connector housings is facilitated by way of a FAKRA defined catch on the jack housing and a cooperating latch on the plug housing.

What is needed is a housing for an electrical connector that is configured to couple with a mating connector, such as a FAKRA connector assembly, in which the housing is also usable to provide an electrical grounding path to a chassis or other panel member.

SUMMARY OF THE INVENTION

The present invention relates to a housing provided for use in an electrical connector assembly. The housing includes an electrically conductive body having a first mating end and a second mating end. The first mating end is configured for coupling an electrical connector assembly. The second mating end is configured for coupling an electrical board assembly. An electrically conductive flange extends through an opening formed in an electrically conductive member and is detachably securable to the electrically conductive member for maintaining electrical communication between the member and the body.

The present invention further relates to an electrical connector. The electrical connector includes a housing including a passageway. An electrical connector is configured to be received within the passageway. The electrical connector includes a dielectric surrounding a pin extending to a contact, the contact further extending exterior of the passageway. The housing includes an electrically conductive body having a first mating end and a second mating end, the first mating end configured for coupling an electrical connector assembly. The second mating end is configured for coupling an electrical board assembly. An electrically conductive flange extends through an opening formed in an electrically conductive member and is detachably securable to the electrically conductive member for maintaining electrical communication between the member and the body.

An advantage of the present invention is that electrical connector housings can be used to provide electrical grounding for mating connector assemblies configured for use with electrical panel assemblies, including FAKRA connector assemblies.

A further advantage of the present invention is that the electrical connector housings can be used with RF electrical appliances.

A still further advantage of the present invention is that electrical connector housings can be used to substantially reduce electrical interference associated with operation of the connector assembly, particularly connector assemblies usable with panel members.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
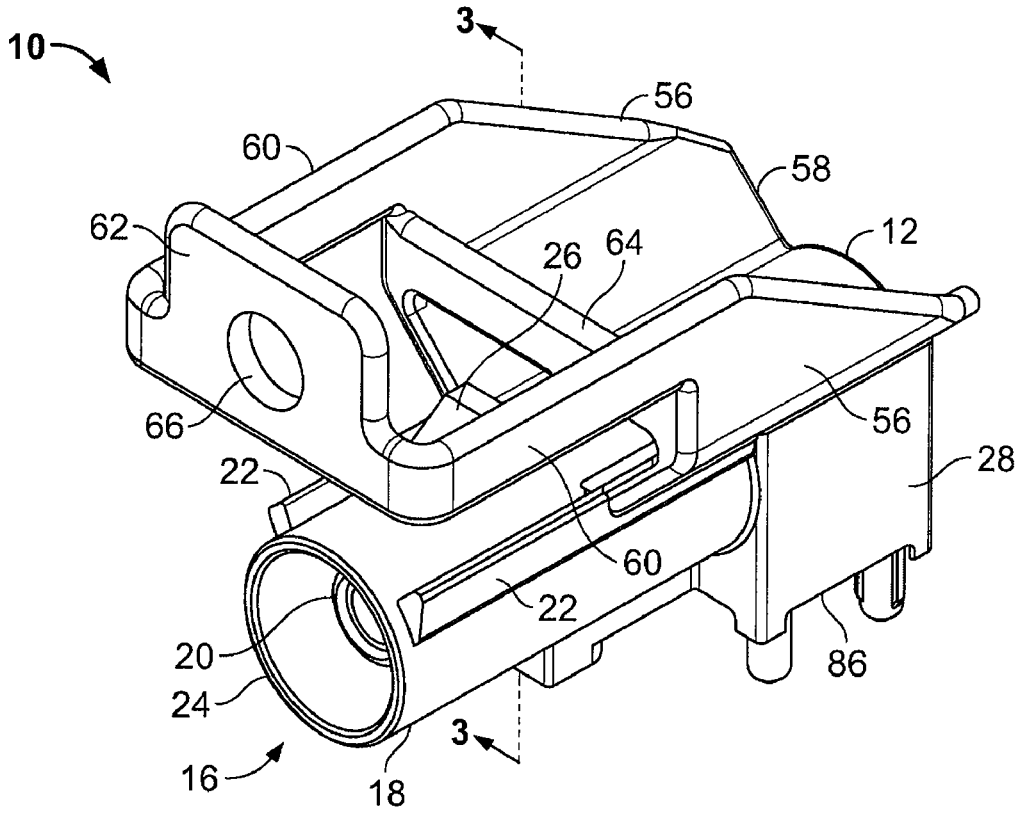
FIG. 1 is a top perspective view of an embodiment of an electrical connector assembly of the present invention.

Referring to FIGS. 1-5, an electrical connector 10 according to the present invention includes a body or housing 12 and coaxial jack connector that is part of the electrical connector 10 and configured to couple to an electrical connector 14 (FIG. 6), such as a mating FAKRA electrical connector 14 including a coaxial plug connector (not shown). Electrical connector 10 is configured for use as a panel connector (panel connector assembly), and as shown in FIGS. 4-7, is secured to an electrically conductive member 72 of an electrical appliance (not shown). In addition, as shown in FIGS. 4-7, electrical connector 10 is also configured for use with a board assembly 76, such as a printed circuit board (PCB). As will be discussed in additional detail below, electrical connector 10 substantially eliminates electrical ground loops by electrically tying the chassis of an electrical appliance via conductive member 72 to board assembly 76. That is, connector 10 establishes both a ground path with board assembly 76 and also with conductive member 72, there being continuity between each ground path.

The present invention applies to the electrical ground circuit of the connector system. That is, the electrical circuit always has continuity to the electrical appliance ground. This electrical ground substantially eliminates stray electromagnetic interference.

It is to be understood that the term panel connector is intended to refer to an electrical connector that is configured to be secured to a member, such as a panel member of a structure or an electrical appliance, in which at least one of the connectors protrudes through or abuts the panel member, such as panel member 72 (see FIG. 4), and mates with or couples another electrical connector. While the panel connector can extend from inside an electrical appliance to mate with or couple an electrical connector disposed exterior of an electrical appliance or structure, both electrical connectors can be disposed either inside or exterior of an electrical appliance or structure. It is also to be understood that while an electrical connector as used herein, such as jack connector 16 (FIGS. 1 and 3) is part of electrical connector 10 (FIG. 3), the terms connector and connector assembly may be used interchangeably. As will be discussed in further detail below, body or housing 12 of electrical connector 10 permits use with radio frequency (RF) electrical appliances. As used herein, an RF electrical appliance is intended to include any electrical appliance that is capable of transmitting and/or receiving RF signals, or otherwise capable of operating with RF signals or an appliance that can be affected by RF signals, adversely or otherwise.

Figure 4:
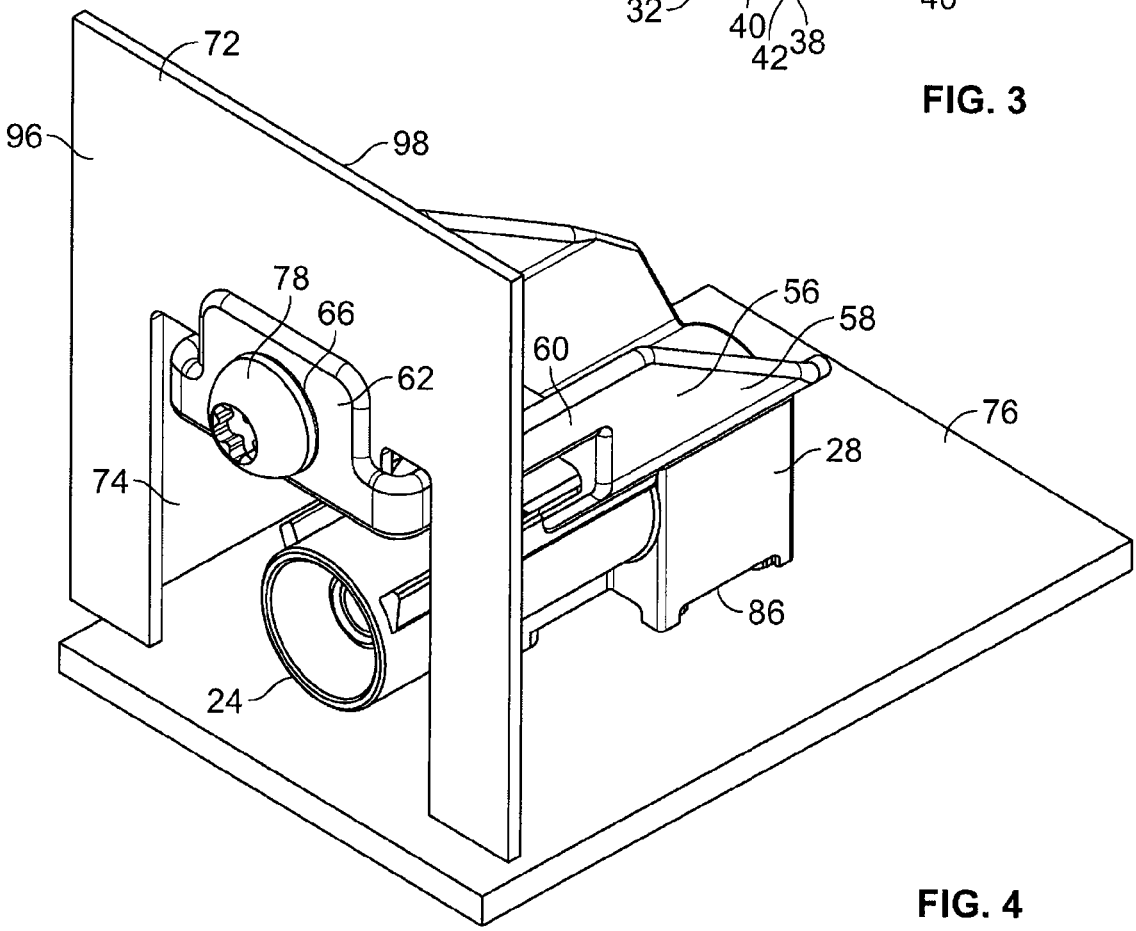
FIG. 4 is a top perspective view of an embodiment of an electrical connector assembly secured to an electrical appliance and mounted on a printed circuit board (PCB) of the present invention.

Housing 12 is preferably fabricated from an electrically conductive material. In one embodiment, housing 12 is constructed of metal, such as a die cast metal. However, in another embodiment, housing 12 may be constructed of a material that is non-electrically conductive, but includes a conductive coating formed on the housing 12. The conductive coating can be applied by spraying, or immersion of housing 12 in a conductive solution, or by other suitable application methods. It is to be understood that housing 12 can also be constructed of combinations of non-electrically conductive materials and/or conductive coatings. In summary, housing 12 can be constructed of any suitable combination of conductive and/or non-conductive materials and conductive and/or non-conductive coatings, so long as RF interference associated with either or both connectors 10, 14 (FIG. 6) and board assembly 76 (FIG. 6) is electrically grounded to the electrically conductive member 72 (FIG. 4). Stated another way, there must be an electrically conductive path between electrically conductive member 72 (FIG. 4) and connector 10, and also between connectors 10, 14, and/or between electrically conductive member 72 (FIG. 4) and each of connectors 10, 14.

Referring to FIGS. 1-5, housing 12 includes an outer annular shell 18 having a mating end 24 for receiving a mating electrical connector, which annular shell 18 extending to a base 28 having a conductor exiting end 86 (see e.g., FIGS. 4-5) to be discussed in further detail below. It is to be understood that although housing 12 is shown as a right angle connector, housing 12 could be a straight connector or have any other angle suitable for connection with a mating connector. An annular alignment portion 20 is formed inside outer annular shell 18, with annular alignment portion 20 having a bore 48 formed longitudinally therethrough. Longitudinally extending radially outward from housing 12 between mating end 24 and base 28 is a key 22, or for example, more than one key 22, such as shown, a pair of keys 22, that inserts into a corresponding keyway (not shown) of connector 14 (FIG. 6) to provide keying between connectors 10, 14. In one embodiment, connector 14 is a FAKRA connector. Also extending radially outward from housing 12 between mating end 24 and base 28 is a retainer 26 that engages an opening 90 (FIG. 6) formed in a latch 88 (FIG. 6) of connector 14 (FIG. 6) when connectors 10, 14 are brought together. This engagement maintains a secure connection between connectors 10, 14.

In one embodiment, as shown, substantially aligned with keys 22 extending radially outward from outer annular shell 18 of the body of housing 12 are corresponding arms 56 extending radially outward from base 28. Each arm 56 includes a first portion 58 that extends radially outward from base 28, and in one embodiment, arms 56 are symmetric about retainer 26. As shown, each first portion 58 extends to a second portion 60 that are substantially parallel to each other, the second portions 60 extending substantially longitudinally past mating end 24 of outer annular shell 18, although other constructions are possible. To provide increased strength and structural rigidity for arms 56, a cross member 64 is provided adjacent the juncture between first and second portions 58, 60 of each of the arms 56. The ends of second portions 60 opposite base 28 extend toward each other, forming a flange 62 having an opening 66. When electrical connector 10 is installed as shown in FIG. 4, flange 62 is directed through an opening 74 formed in electrically conductive member 72 and is brought into abutting contact with electrically conductive member 72. This abutting contact between electrical conductive member 72 and flange 62 establishes both mechanical and electrical contact, as will be discussed in additional detail below.

In addition to establishing abutting contact with electrically conductive member 72, electrical connector 10 includes grounding posts 32 and a center contact 36 extending from conductor exiting end 86 of base 28 which are installed in corresponding openings in board assembly 76 as will be discussed in further detail below. To secure flange 62 in abutting, i.e., electrical, contact with electrically conductive member 72, a fastener 78, such as a screw, is directed through opening 66 of flange 62 and actuated through an aligned opening formed in electrically conductive member 72 to draw flange 62 into abutting contact with electrically conductive member 72. Providing sufficient abutting contact between electrically conductive member 72 and flange 62 substantially eliminates electrical ground loops by electrically tying the chassis of an electrical appliance via conductive member 72 to board assembly 76. In other words, connector 10 establishes both a ground path with board assembly 76 and also with conductive member 72, there being continuity between each ground path. Thus, housing 12 of electrical connector 10 permits shielding of signal contacts from unwanted outside noise voltages.

Figure 7:
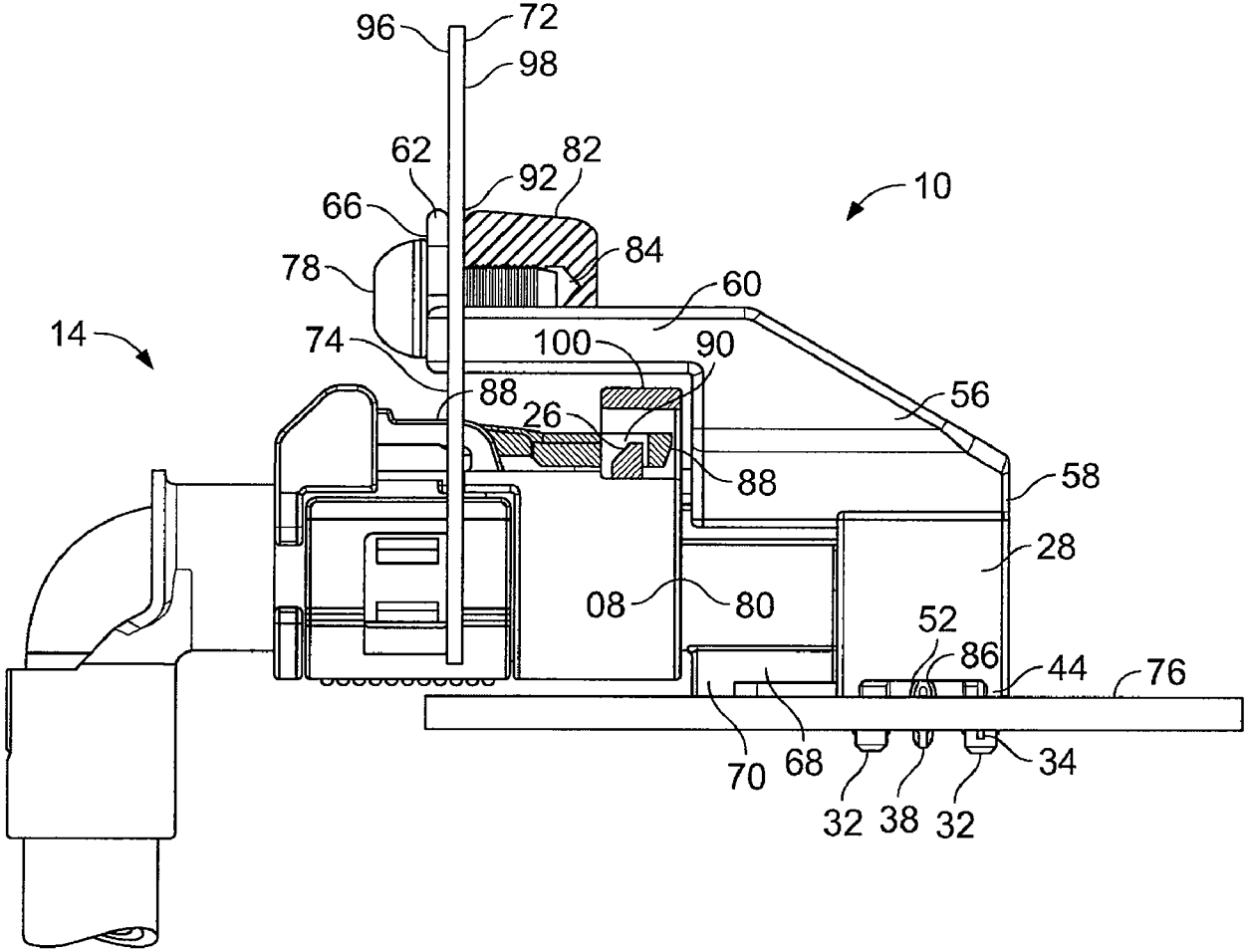
FIG. 7 is a partial cutaway side elevation view of the embodiment of coupled electrical connectors secured to the electrical appliance and PCB of FIG. 6.

In an alternate embodiment, as shown in FIG. 7, a slot 92 is formed between flange 62 and a backing portion 82 that is longitudinally aligned with flange 62. A bore 84 substantially aligned with opening 66 formed in flange 62 defines an open-ended hollow portion or chamber in backing portion 82. That is, bore 84 is in communication with opening 66, but does not fully extend through backing portion 82. Connector 10 is secured by directing flange 62 through opening 74 and then directing flange 62 upwardly so that slot 92 is received between flange 62 and backing portion 82. Stated another way, the opposed surfaces of slot 92 are adjacent to opposed surfaces 96, 98 of electrically conductive member 72. Once connector 10 is initially secured, fastener 78 is directed through opening 66, slot 92 and then into bore 84, as shown in the partial cutaway view in FIG. 7. Fastener 78 is then actuated in one direction to draw fastener 78 inside bore 84 until the head of fastener 78 is brought into abutting contact with a surface 96 of flange 62 that faces exterior of the electrical appliance, thus securing connector 10 in abutting contact with conductive member 72. By virtue of bore 84 becoming a substantially closed space once fastener 78 is inserted into bore 84, debris associated with securing flange 62 to conductive member 72, for example, shavings of backing portion 82, is substantially prevented from reaching the interior of the electrical appliance. Stated another way, debris, such as shavings of backing portion 82 removed by fastener 78 while fastener 78 is actuated, are substantially confined inside of bore 84, substantially preventing the debris from reaching the interior of the electrical appliance.

With respect now to FIG. 3, the coaxial jack connector 16, which is incorporated into electrical connector 10, will be described in greater detail. Coaxial jack connector 16 includes a dielectric 54 having an annular portion 59 that is received by the annular alignment portion 20 of housing 12. Dielectric 54 secures a pin 52 that extends inside of annular portion 59. Annular portion 59 includes a bore 48 that longitudinally extends substantially through housing 12, i.e., adjacent mating end 24 toward end 94 of base 28 (see also FIG. 1). As shown, a channel 50 formed in conductor exiting end 86 is substantially transverse to and in communication with bore 48. At the juncture of bore 48 and channel 50, which bore 48 and channel 50 collectively defining a passageway, pin 52 further transversely extends to an end 38 that extends through channel 50 and outwardly from conductor exiting end 86. Pin 52 electrically carries an RF signal between mating connector 14 (FIGS. 6-7) and board assembly 76. End 38 can be tapered to more easily permit mating contact with a corresponding opening (not shown) in board assembly 76. In one embodiment, adjacent to end 38 are a pair of legs 40 separated by a tapered opening 42, which tapered opening 42 provides improved abutting contact between legs 40 and the corresponding opening of the board assembly 76. This combination of legs 40 and opening 42 is often referred to as "an eye of a needle".

Figure 2:
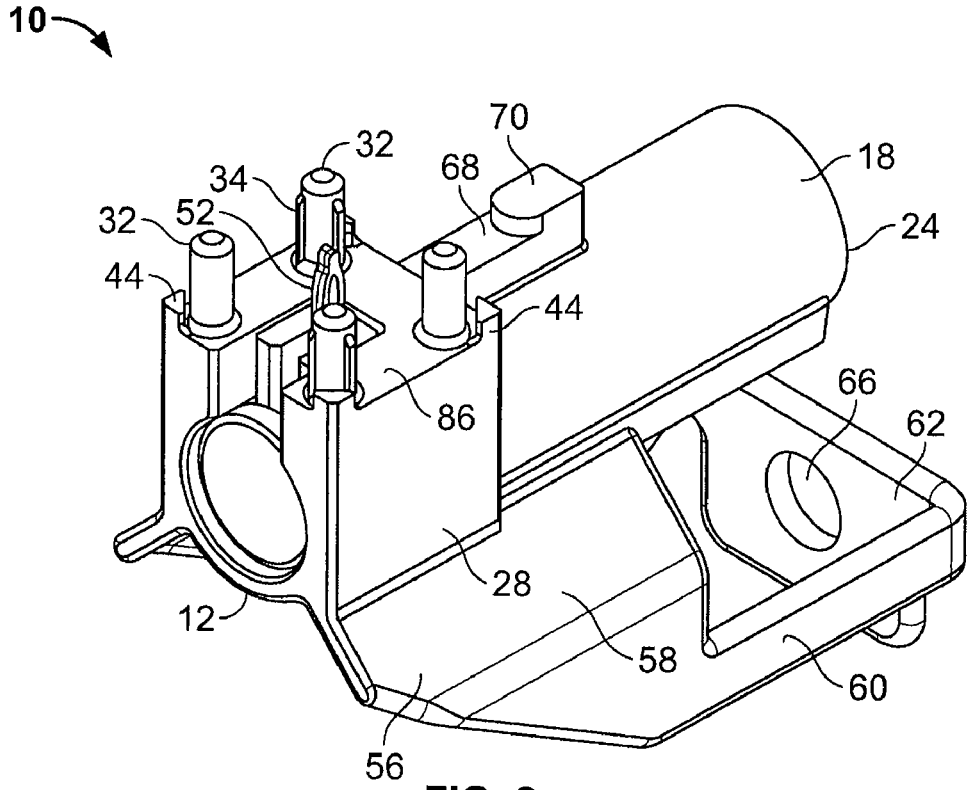
FIG. 2 is a perspective view of the embodiment of an electrical connector assembly inverted with respect to FIG. 1 of the present invention.
Figure 3:
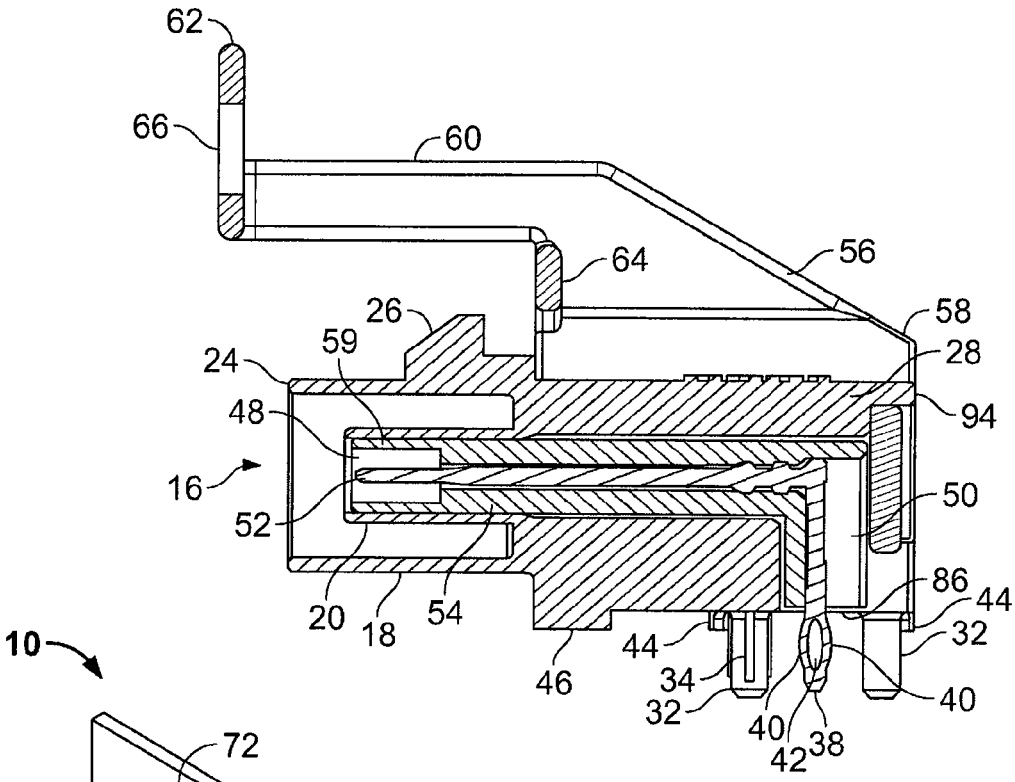
FIG. 3 is a cross section taken along line 3-3 of FIG. 1 of an embodiment of an electrical connector assembly of the present invention.
Figure 5:
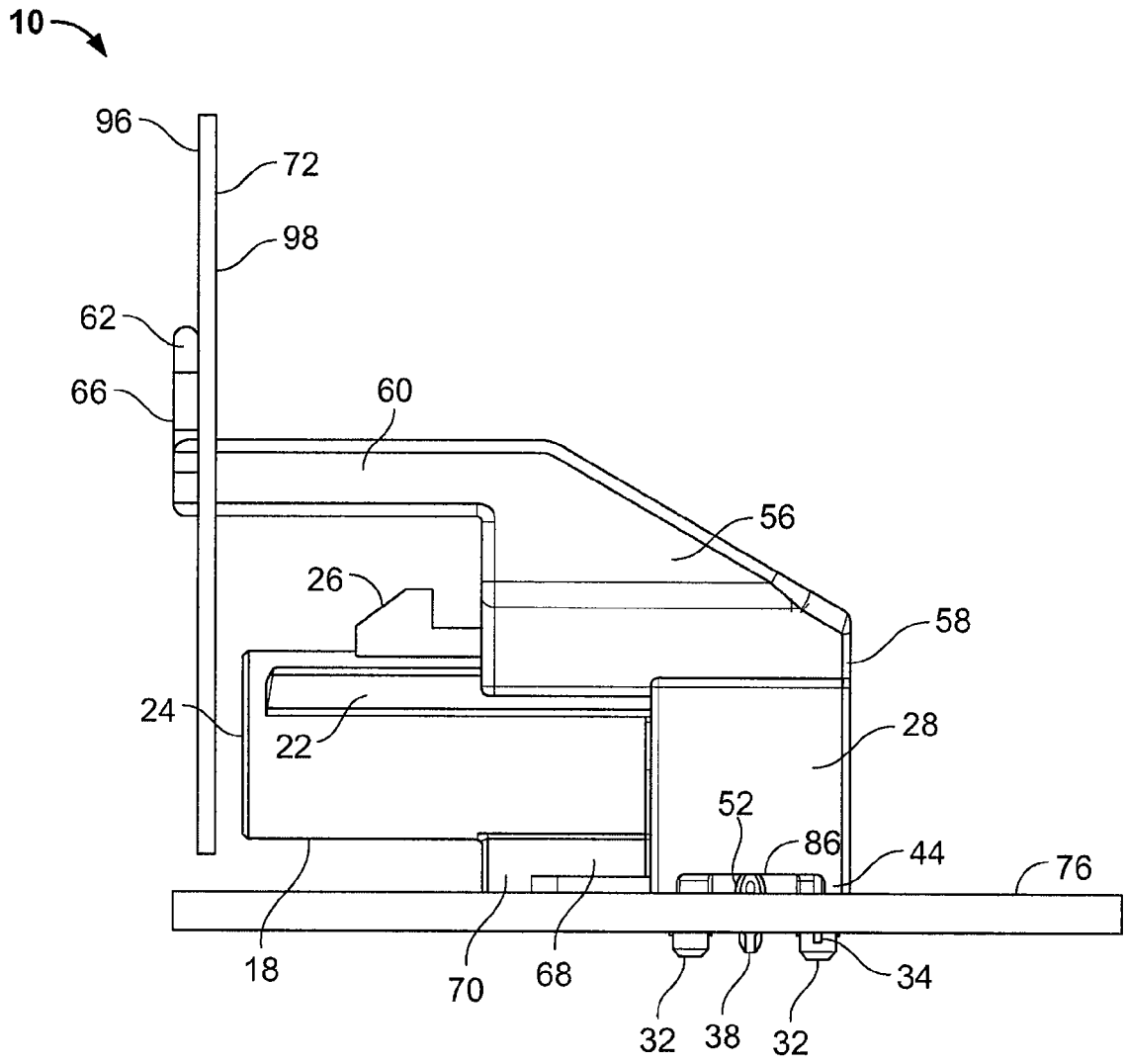
FIG. 5 is a side elevation view of an embodiment of an electrical connector assembly secured to an electrical appliance and mounted on a PCB of the present invention.

Referring to FIGS. 1-3, grounding posts 32 extend outwardly away from conductor exiting end 86 of base 28. Optionally, one or more of grounding posts 32 include radially outwardly extending fins 34. If the corresponding openings (not shown) in board assembly 76 for receiving posts 32 are properly sized, it may not be necessary to use solder to secure the posts 32 to board assembly 76 when fins 34 are utilized. Grounding posts 32 provide an electrical ground between housing 12 and board assembly 76. Adjacent to each of grounding posts 32 are standoffs 44, as shown at the corners of base 28 that uniformly set the spacing between conductor exiting end 86 and the board assembly 76. A rib 68 extends longitudinally from base 28 toward mating end 24, terminating at a standoff 70, also referred to as a board standoff. As shown in FIG. 5, standoff 70, which is substantially coincident with each of standoffs 44, provides an anti-tipping component, since the center of gravity of electrical connector 10 may fall outside the footprint of base standoffs 44.

Figure 6:
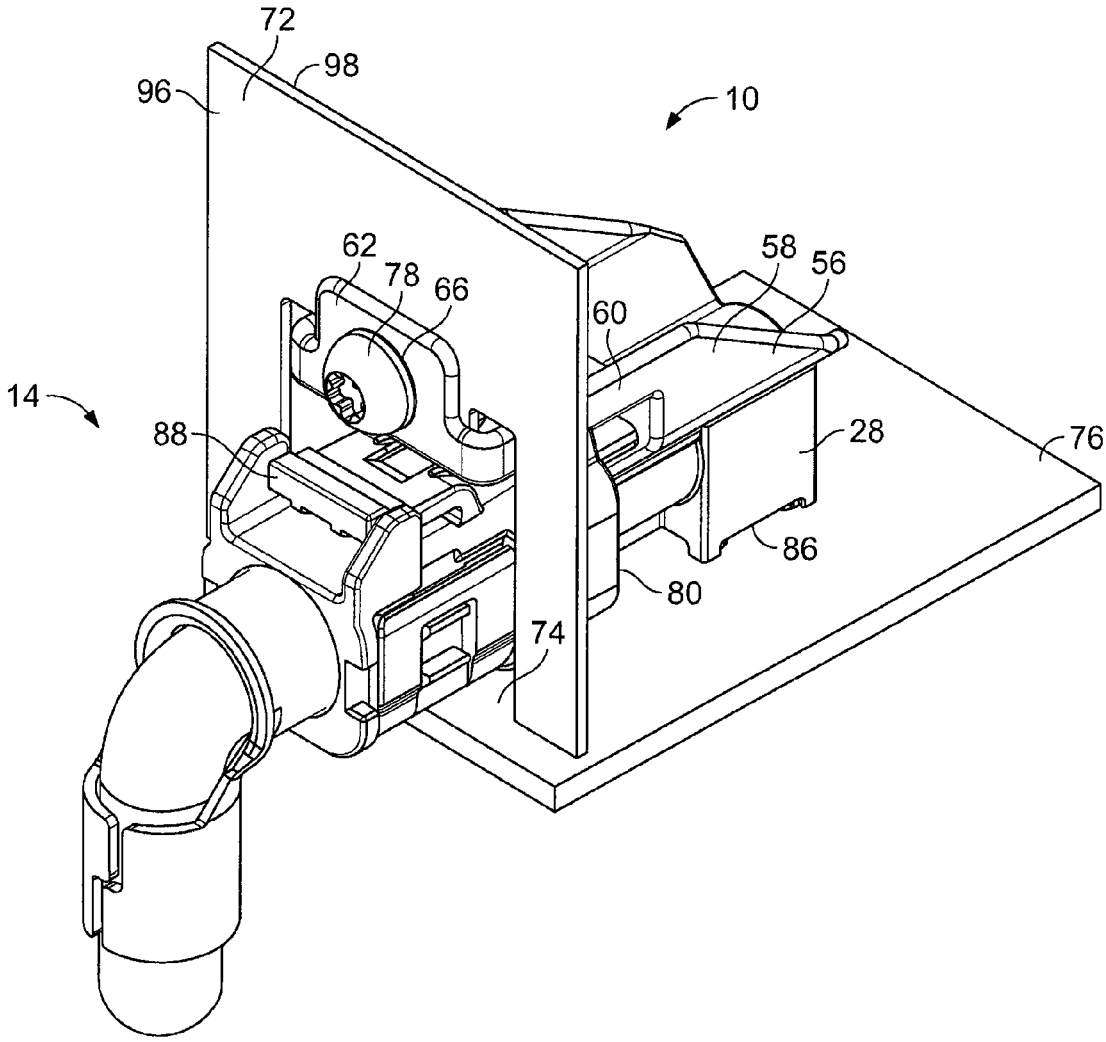
FIG. 6 is a top perspective view of the embodiment of an electrical connector and electrical appliance of FIG. 4 coupled to a mating connector assembly of the present invention.

Referring to FIGS. 6 and 7, connector 10 is coupled with mating connector 14, such as a FAKRA connector. Electrically conductive member 72 is a part of an electrical appliance, and in one embodiment, conductive member 72 is part of an enclosure for an electrical appliance. Conductive member 72 is used to establish an electrical ground, either directly or indirectly, for both of connectors 10, 14, as will be discussed in additional detail below. In one embodiment, flange 62 of connector 10 is secured to surface 96 that faces exterior of the electrical appliance. Mating end 24 of connector 10 is directed through opening 74 of conductive member 72 until flange 62 abuts surface 96. Once abutting contact is achieved, fastener 78 is directed through opening 66 of flange 62 of connector 10 and actuated to secure flange 62 in secured abutting contact with surface 96 of electrically conductive member 72.

Figure 8:
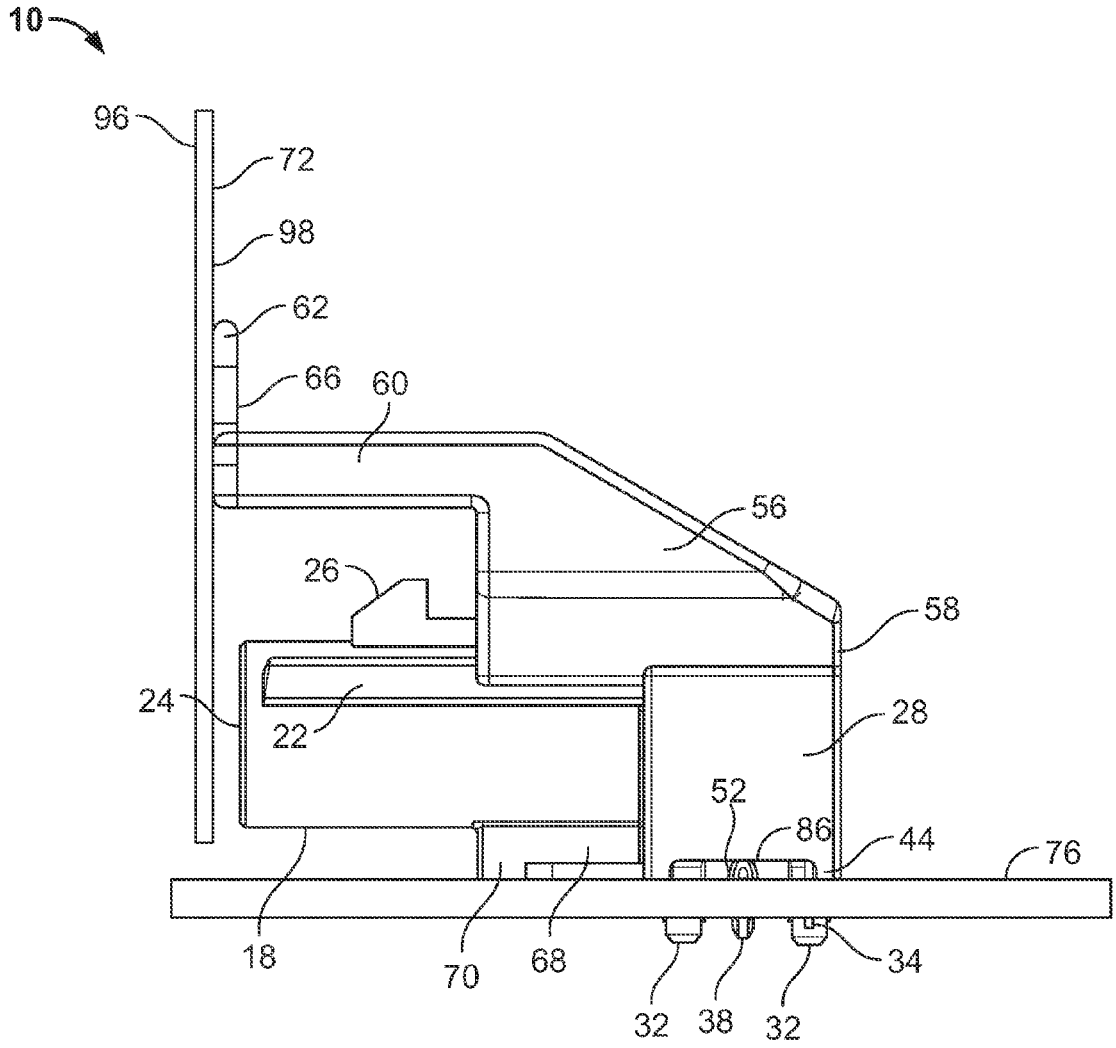
FIG. 8 is a side elevation view of an embodiment of an electrical connector assembly secured to an electrical appliance and mounted on a PCB of the present invention.

To complete the installation or assembly between connectors 10 and 14, a mating end 80 of connector 14 is brought into mating engagement with mating end 24 of connector 10. As shown in FIG. 7, which includes a partial cutaway view of a hood 100 of connector 14, connectors 10 and 14 are secured together once retainer 26 is received in opening 90 of latch 88. Referring to back to FIG. 4, it is appreciated by those skilled in the art that due to housing 12 and conductive member 72 being electrically conductive, as discussed above, there is at least one electrically conductive path established between electrically conductive member 72 and connector 10 sufficient to electrically ground connector 10 with conductive member 72. In other words, an electrically conductive path may be established between conductive member 72 and housing 12 by virtue of abutting contact between any of surfaces of conductive member 72, for example, surfaces 96, 98 and/or any edge along the periphery of opening 74, and any surface of housing 12 that abuts any surface of conductive member 72. It is to be understood that flange 62 can be configured to abut either of surfaces 96 or 98, as shown in FIGS. 5 and 8, respectively, FIG. 5 corresponding to flange 62 being disposed exterior of an electrical appliance, and FIG. 8 corresponding to flange 62 being disposed interior of an electrical appliance.

At least one electrically conductive path is established between connector 14 and electrically conductive member 72 and/or between connector 14 and connector 10. That is, in one embodiment, it is possible that housing 12 of connector 10 does not provide a sufficient electrically conductive path between connector 14, so long as connector 10 is configured to ensure that a sufficient electrically conductive path is provided between connector 14 and conductive member 72 which is sufficient to electrically ground connector 14 with conductive member 72.

In summary, referring back to FIG. 4, housing 12 can be constructed of any suitable combination of conductive materials and conductive and/or non-conductive coatings, so long as RF interference associated with either or both connectors 10, 14 is grounded to the electrically conductive member 72. Stated another way, there must be an electrically conductive path or electrical communication between electrically conductive member 72 and connector 10, and in one embodiment, between electrically conductive member 72 and connectors 10, 14, as previously discussed.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A connector for use in an electrical connector assembly, comprising:

an electrically conductive body having at least a contact, a first mating end and a second mating end, the first mating end configured for coupling an electrical connector, the second mating end configured for coupling an electrical board assembly, the body having at least an arm including a first portion extending from the body and a second portion connected with the first portion and extending along the body; and an electrically conductive flange including a hole, the flange extending outwardly from an end of the second portion of the arm, the arm in electrical communication with the body and spacing from the first mating end, the flange extending through an opening formed in an electrically conductive member and detachably securable to the electrically conductive member for maintaining electrical communication between the member and the body.

2. The connector of claim 1 wherein the electrical connector is a FAKRA connector.

3. The housing of claim 1 wherein the body is constructed of metal.

4. The housing of claim 2 wherein the body is constructed of die cast metal.

5. The housing of claim 1 wherein a conductive coating is formed on the body.

6. The housing of claim 1 wherein the electrically conductive member is a part of an electrical appliance.

7. The housing of claim 1 wherein the electrically conductive member is a part of an electrical appliance enclosure.

8. The housing of claim 7 wherein the flange is disposed interior of the electrical appliance.

9. The housing of claim 7 wherein the flange is disposed exterior of the electrical appliance.

10. The housing of claim 1 wherein the flange includes a hollow portion for substantially preventing debris associated with securing the flange to the member from reaching the interior of the electrical appliance.

* * * * *